US006865782B2

(12) United States Patent
Takazawa et al.

(10) Patent No.: US 6,865,782 B2
(45) Date of Patent: Mar. 15, 2005

(54) SLIDE FASTENER WITH SEPARABLE BOTTOM STOP ASSEMBLY AND METHOD OF MANUFACTURING THE SAME

(75) Inventors: Shigeyoshi Takazawa, Cheshire (GB); Osamu Igarashi, Toyama-ken (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 10/315,368

(22) Filed: Dec. 10, 2002

(65) Prior Publication Data

US 2003/0115724 A1 Jun. 26, 2003

(30) Foreign Application Priority Data

Dec. 21, 2001 (JP) ..... 2001-390242

(51) Int. Cl.[7] ..... A44B 19/38
(52) U.S. Cl. ..... 24/388; 24/433
(58) Field of Search ..... 24/386, 388, 398, 24/433, 434

(56) References Cited

U.S. PATENT DOCUMENTS 3,616,939 A * 11/1971 Potin ..... 24/433
4,110,891 A 9/1978 Akashi
4,485,532 A * 12/1984 Yoshida et al. ..... 24/381
4,536,923 A * 8/1985 Murakami ..... 24/433
4,660,258 A * 4/1987 Horita ..... 24/433
4,976,016 A * 12/1990 Takabatake ..... 24/433
5,728,460 A * 3/1998 Hirasawa et al. ..... 428/349

FOREIGN PATENT DOCUMENTS

| | | |
|---|---|---|
| DE | 80 08 553 | 10/1980 |
| EP | 0 612 487 A1 | 8/1994 |
| GB | 1 339 302 | 12/1973 |
| JP | 56-29524 | 7/1981 |

* cited by examiner

*Primary Examiner*—Robert J. Sandy
(74) *Attorney, Agent, or Firm*—Michael S. Leonard; Everest Intellectual Property Law Group

(57) ABSTRACT

A slide fastener in which an insert pin and a box pin of a separable bottom stop assembly made of synthetic resin are molded integrally along side edges of fastener tapes. The insert pin and the box pin have peripheral shapes allowing themselves to be inserted into element row guide grooves of a slider, and are molded integrally such that the entire insert pin and the box pin incline toward rear face sides of the respective tapes from their inner side edges to outer side edges relative to tape planes of the fastener, said rear face sides having no core threads of the core portions. Thus, resin layers having substantially even thickness can be formed on both the front and rear face sides of the core portions so that the resin layers never peel away from rear surfaces of the fastener tapes, and the core portions and their peripheries never become brittle.

1 Claim, 5 Drawing Sheets

SLIDE FASTENER WITH SEPARABLE BOTTOM STOP ASSEMBLY AND METHOD OF MANUFACTURING THE SAME

BACKGROUND OF THE INVENTION

1. Field of the Invention

The present invention relates to a slide fastener having a separable bottom stop assembly at a bottom stopper portion thereof and a method of manufacturing the same.

2. Description of the Prior Art

Conventionally, in a slide fastener in which a coiled or zigzagged fastener element row made of synthetic resin monofilament is attached on a face of a tape by sewing or the like, a core thread is inserted through the fastener element row at a sewed portion of the element row and each element portion of the fastener element row is sewed together with this core thread by sewing yarn. When a separable bottom stop assembly comprising an insert pin, a box pin and a box is attached to a core portion consisting of the core thread and a tape edge portion exposed adjacent a bottom end of the fastener element row attached in the above manner, a tape face side becomes thick because of the existence of the core thread at the core portion. Thus, the thickness of the insert pin and the box pin molded integrally is limited by a section of an element guide groove formed between upper and lower blade plates of a slider, so that the front face side of the fastener tape naturally has to be thickened.

If the volume of resin located on a rear face side decreases when the insert pin and the box pin of synthetic resin are fixed around the core portion at the same time when they are molded, the insert pin and the box pin come to easily peel away from the core portion. As a consequence, the separable bottom stop assembly is broken. To avoid such a damage, according to Japanese Patent Publication No. 56-29524, for example, a tape portion of a core portion is folded stepwise and upward with respect to a fastener tape face so as to fit tightly to a core thread side. After heating the core portion and the periphery of the core portion, the insert pin and the box pin with their thickness substantially equal to the vertical height of the element row are formed around the core portion by injection molding. According to the molding method of this separable bottom stop assembly, a large amount of resin can be also disposed on a rear face side of the core portion. Therefore, the resin does not peel even at the rear face side of the core portion, so durability of the separable bottom stop assembly increases.

However, this method requires a heating apparatus for applying enough heat to the core portion and its periphery in preliminary heat-setting so as to stabilize the folded configuration of the fastener tape. In addition, its thermal history is so large that the core portion and the surrounding portion thereof become brittle. Consequently, the insert pin and the box pin attached around the core portion easily split at their boundary. Additionally, as mentioned above, even if heat-setting is conducted, the configurations of the core portion and its periphery in a cavity may not be maintained upon molding of the separable bottom stop assembly.

SUMMARY OF THE INVENTION

The present invention has been achieved to solve the above-described problems. An object of this invention is to provide a slide fastener and a method for efficiently manufacturing the same, in which an insert pin or a box pin with substantially even thickness is formed around a core portion without other equipment than an injection-molding machine and without making the core portion and its periphery brittle.

To achieve the above object, according to the present invention, there is provided a slide fastener having linear fastener element rows along opposing side edges of a pair of fastener tapes and the separable bottom stop assembly comprising an insert pin, a box pin and a box made of synthetic resin at an end thereof, said insert pin and said box pin being formed integrally by injection molding so as to include core portions adjacent end portions of the fastener element rows. In this slide fastener, the insert pin and the box pin have peripheral shapes allowing themselves to be inserted into element row guide grooves of a slider. The insert pin and the box pin are molded integrally such that the entire insert pin and box pin incline toward a rear face side of the tape from their inner side edges to outer side edges relative to a tape plane of the fastener, said rear face side having no core thread of the core portion.

The sectional shapes of the insert pin and the box pin of the present invention is not different from the conventional ones. However, the insert pin and the box pin are inclined at a predetermined angle from their inner edges to their outer edges toward the rear face side, or the side without core thread, opposite to the front face to which the fastener element row is attached. Consequently, a sufficient amount of resin material for the insert pin and the box pin is supplied also to the rear face side of the core portion. Thus, the thickness of the resin on the rear face side can be approximated to the thickness of the resin on the front face side. Accordingly, possibility of damage due to peel of resin at the rear face side of the core portion can be minimized.

The slide fastener having above-described structure can be produced by the following two manufacturing methods.

According to a first manufacturing method of a slide fastener with a separable bottom stop assembly, the fastener is provided with the linear fastener element rows along the opposing side edges of a pair of the fastener tapes and the separable bottom stop assembly comprising the insert pin, the box pin and the box made of synthetic resin, said insert pin and said box pin being molded integrally so as to include the core portion at the bottom end of each of the fastener element rows. This manufacturing method comprises: introducing the core portion into an injection-molding die for the insert pin or the box pin; pressing the core portion disposed in the molding cavity from the rear face side without the core thread to the front face side of the fastener tape; and injecting molten resin into the molding cavity so that the molten resin flows into molding spaces on the front and rear face sides of the core portion and fixes to the periphery of the core portion.

According to a second manufacturing method of a slide fastener, the fastener is provided with the linear fastener element rows along the opposing side edges of a pair of the fastener tapes and the separable bottom stop assembly comprising the insert pin, the box pin and the box made of synthetic resin, said insert pin and said box pin being molded integrally so as to include the core portion at the bottom end of each of the fastener element rows. This manufacturing method further comprises: forming the molding cavity for the insert pin or the box pin in the injection-molding die so that said cavity may incline relative to a core-portion-insertion plane toward a rear face side without the core thread of the fastener tape; introducing the core portion into the molding die for the insert pin or the box pin; maintaining the core portion without bending a tape portion around its border with the core portion disposed in the molding cavity;

and injecting molten resin into the molding cavity so that the molten resin flows into molding spaces on the front and rear face sides of the core portion and fixes to the periphery of the core portion.

According to the first manufacturing method, an inner face on the front face side of the molded product and an inner face on the rear face side thereof are substantially parallel to the fastener tape in the section of the molding cavity, as in conventional ones. Preferably, a pin for pressing the core portion from the rear face side to the front face side of the fastener tape is provided protrusively in the cavity. If so, the core portion inclines downward due to its own weight so as not to block flow of molten resin into the rear face side of the core portion.

According to the second manufacturing method, the molding cavity is formed such that its entire section inclines relative to the core-portion-insertion plane toward the rear face side of the fastener tape. Preferably, the pin for maintaining the core portion in parallel to the tape plane of the fastener tape is provided protrusively in the cavity. If so, the core portion never inclines downward due to its own weight and spaces into which a sufficient amount of molten resin flows can be secured on both the front and rear face sides of the core portion. Consequently, the molten resin smoothly flows into the rear face side of the core portion.

According to the above two manufacturing methods, a conventional injection-molding machine for producing the separable bottom stop assembly can be used directly if the molding cavity in the molding die is formed as described above, while the manufacturing method disclosed in the above patent publication requires such special equipment as a heat-setting device. Thus, special heat treatment is unnecessary except in molding, so that the core portion and the fastener tape nearby never become brittle. Furthermore, the insert pin and the box pin having substantially even thickness can be formed at the core portion and the front and rear face sides of the nearby fastener tape.

DESCRIPTION OF THE PREFERRED EMBODIMENTS

Hereinafter, preferred embodiments of the present invention will be described in detail with reference to the accompanying drawings.

Generally in this kind of a slide fastener with a separable bottom stop assembly, elements between adjacent slide fastener units of the fastener chain are removed so as to form a space portion. Then, a reinforcement tape is fixed to the entire fastener tape in a substantially half part in the longitudinal direction of the space portion so as to produce a reinforced portion. The space portion is cut out with a fixed portion of the reinforcement tape left and then a separable bottom stop assembly made of metal or synthetic resin is fixed along opposing edge portions so as to nip said edge portions.

Figure 4:
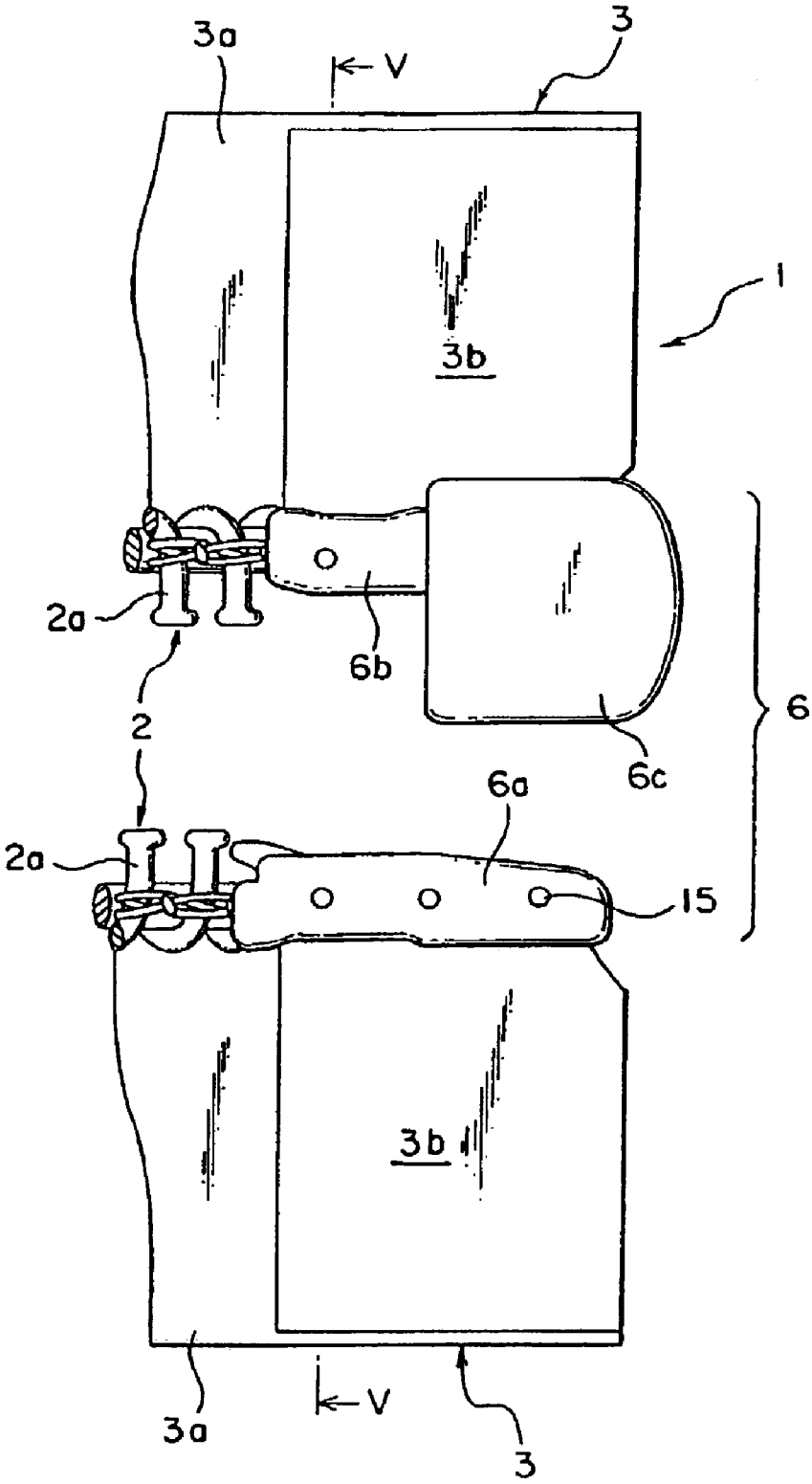
FIG. 4 is a plan view of major portions of an attaching portion of a separable bottom stop assembly of a slide fastener according to said first embodiment.

In the slide fastener 1 with a separable bottom stop assembly of the present invention, as shown in FIG. 4, fastener element rows 2 formed in a coiled shape with synthetic resin monofilament are fixed by sewing along opposing side edges of a pair of fastener tapes 3, 3 made of woven fabric. Upon sewing and using this fastener, a core thread 4 is passed through the interior of each of the fastener element rows 2 so as to maintain a shape of each element portion 2*a* of said fastener element rows 2. When the fastener element rows 2 are fixed by sewing along the opposing side edges of the fastener tapes 3, 3, part of sewing thread crosses over each element portion 2*a* of the fastener element rows 2 so as to be pierced through the core thread 4 and the fastener tape 3 and sewed thereto.

Thus, the core thread 4 is exposed at the space portion where part of the element portion 2*a* of the fastener element row 2 is removed, so that the core thread 4 is connected to one face side of the fastener tape 3 by the sewing thread. When looked from a side face, said one surface side of the core portion 7 of the fastener tape 3 is thicker than a fastener tape main body 3*a* by the thickness of the core thread 4.

As a method of fixing the coiled fastener element row 2 to the fastener tape 3, although not shown in the figure, the coiled fastener element row made from monofilament can be woven or knitted onto the fastener tape when the fastener tape is produced by weaving or knitting. In this case also, the core thread 4 is passed through the fastener element row. In FIG. 4, the fastener element row is formed in a coiled shape. Yet, instead of the coiled fastener element row, a zigzagged fastener element row may be employed which is produced by folding a zigzagged monofilament at the center of the width direction.

According to this embodiment, an upper stop end (not shown) is fixed at an upper end of each of the fastener element rows 2, 2 so as to restrict the sliding operation of a slider (not shown). As described above, the reinforcement tape 5 is fused together with a fastener tape portion 3*b* adjacent a bottom end of each of the fastener element rows 2, 2 by ultrasonic heating or high frequency heating. Then, an insert pin 6*a* and a box pin 6*b* of a separable bottom stop assembly 6 are molded integrally along the core portions 7 of opposing edge portions of the reinforcement tapes 5 by injection molding. The reinforcement tape 5 is produced from taffeta fabric made from synthetic fiber or thermoplastic synthetic resin film. When synthetic resin film is used, its surface is knurled so as eliminate the surface gloss. Reference numeral 6*c* in FIG. 4 denotes a box which is fixed to a front end side of the box pin 6*b* and has an insertion hole into which the insert pin 6*a* is to be inserted.

Figure 1:
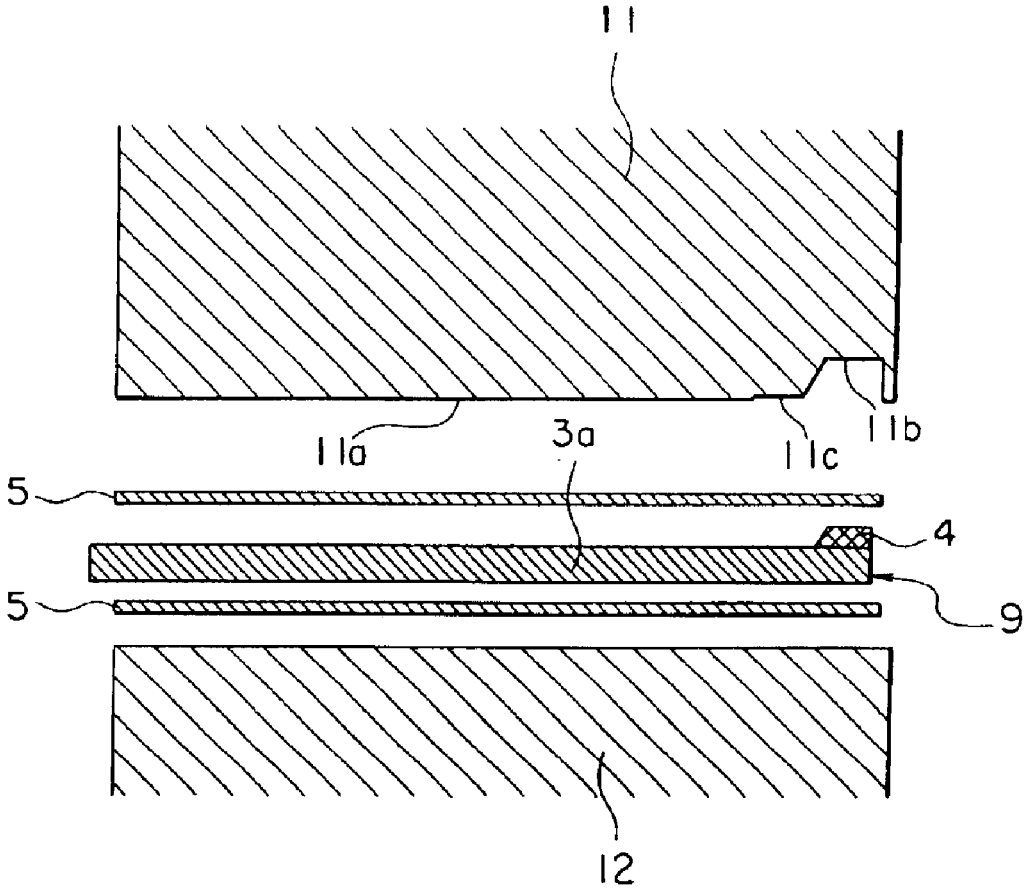
FIG. 1 is a transverse sectional view showing an insertion condition of a reinforcement tape and a core portion in an ultrasonic heating apparatus.
Figure 2:
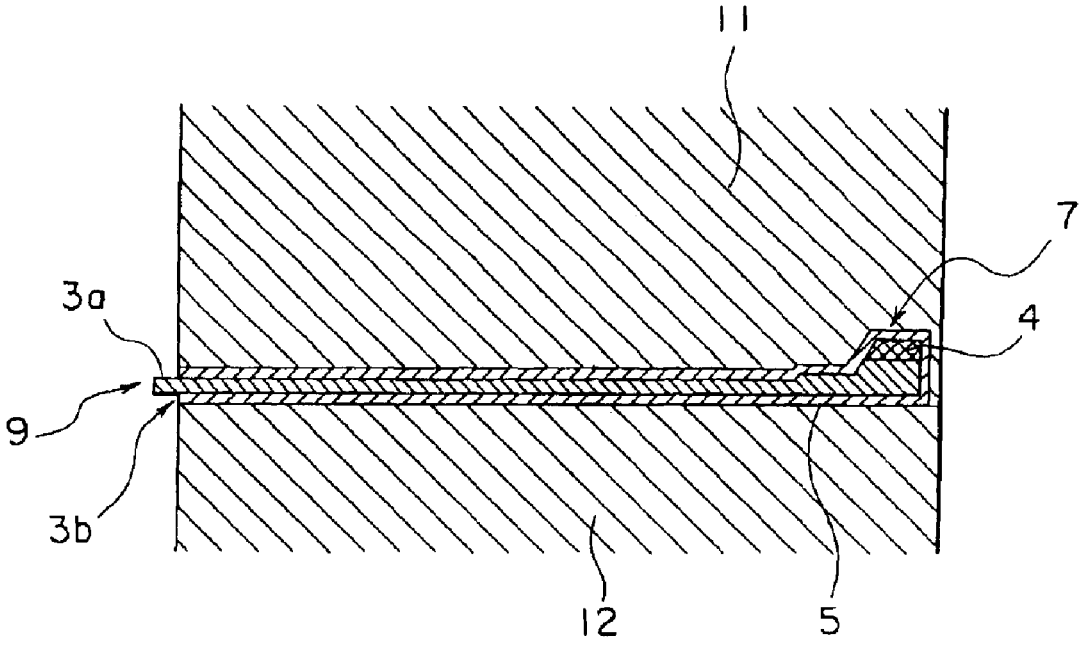
FIG. 2 is a transverse sectional view showing a condition at the time of heating by the ultrasonic heating apparatus.

FIGS. 1 and 2 are explanatory diagrams showing an example of a fusing process in which the reinforcement tape 5 is fused integrally to a space portion of a slide fastener chain 9.

In these figures, reference numeral 11 denotes an ultrasonic horn and reference numeral 12 denotes an anvil to be disposed opposing to a pressing face of the ultrasonic horn 11. The ultrasonic horn 11 and the anvil 12 are located at standby positions with a predetermined interval as shown in FIG. 1 and a fastener tape portion of the space portion of the slide fastener chain 9 is inserted between them. At the same time, two reinforcement tapes 5, 5 are inserted so as to sandwich the entire front and rear faces of the fastener tape portion. A core portion press-molding groove 11*b* is formed at the pressing face 11*a* of the ultrasonic horn 11. Also, a slight step portion 11*c* is formed in an adjacent portion of the core portion press-molding groove 11*b* and in a flat plane adjacent the core portion press-molding groove 11*b*. On the other hand, the pressing face of the anvil 12 disposed opposing to the ultrasonic horn 11 is entirely flat.

The ultrasonic horn 11 and the anvil 12 move in directions approaching each other, so that, as shown in FIG. 2, the reinforcement tapes 5, 5 are pressed tightly to the core portion 7 having the core thread 4 extended in the tape length direction and the entire front and rear faces of the fastener tape 3 including the core portion 7 such that the core portion 7 is embraced. Upon this press-fitting, pressing force at part of the tape portion 3*b* corresponding to the step portion 11*c* formed at the pressing face 11*a* of the ultrasonic horn 11 is weaker than the pressing force at the other part of the tape portion 3*b*. Thus, the tape portion corresponding to the step portion 11*c* keeps plasticity after the reinforcement tape 5 is fused, so that the tape portion 3*b* adjacent the core portion 7 never becomes brittle.

After this press-fitting is carried out, an ultrasonic oscillator (not shown) is actuated at a predetermined amplitude and for a predetermined time so as to vibrate the ultrasonic horn. Consequently, the reinforcement tapes 5, 5 are heated by internal heating in their entire face in contact with the core thread 4 and the fastener tape main body 3*a* and fused together with the core portion 7 and the fastener tape main body 3*a*.

Figure 3:
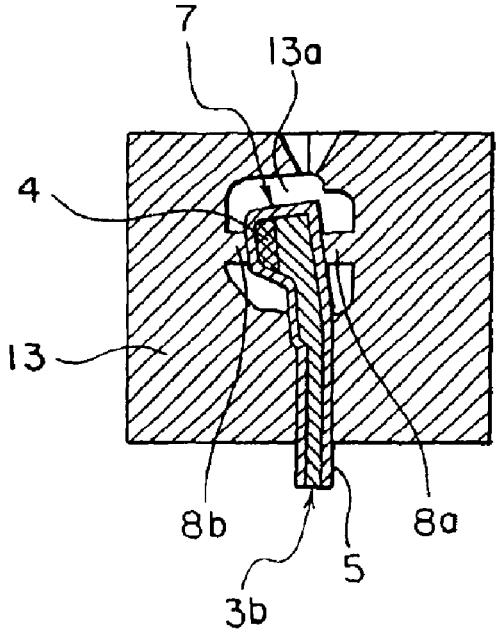
FIG. 3 is a sectional view showing a closed condition of a mold for molding an insert pin or a box pin of a separable bottom stop assembly integrally with a core portion of a fastener tape according to a first embodiment of the present invention.

FIG. 3 shows a condition in which the fastener tape portion 3*b* with reinforcement tapes is inserted into a molding cavity 13*a* formed in a molding die 13 for molding the insert pin 6*a* or the box pin 6*b* of the separable bottom stop assembly 6 integrally with the core portion 7 in the first embodiment of the present invention. The sectional shape is not different from an ordinary one as evident from FIG. 3. Yet, the core portion 7, which is an opposing side edge of the fastener tape portion 3*b* with reinforcement tape inserted into the molding cavity 13*a*, is disposed so as to incline toward a side where the core thread 4 is attached.

To maintain the core portion 7 such that it inclines at a predetermined angle inside the molding cavity 13*a* toward the side where the core thread 4 is attached, means for keeping this inclined posture is necessary. The means for maintaining this inclined posture is adopted, having a structure in which pins 8*a*, 8*b* are protruded inward from the inner faces on both sides of the molding cavity 13*a* across the core portion 7 such that said pins 8*a*, 8*b* oppose each other. Several pairs of pins 8*a*, 8*b* are provided in the tape length direction of the molding cavity 13*a*. The inclination angle of the core portion 7 relative to the tape portion 3*b* side is altered as the protrusion lengths of the pair of pins 8*a*, 8*b* are changed relatively.

Figure 5:
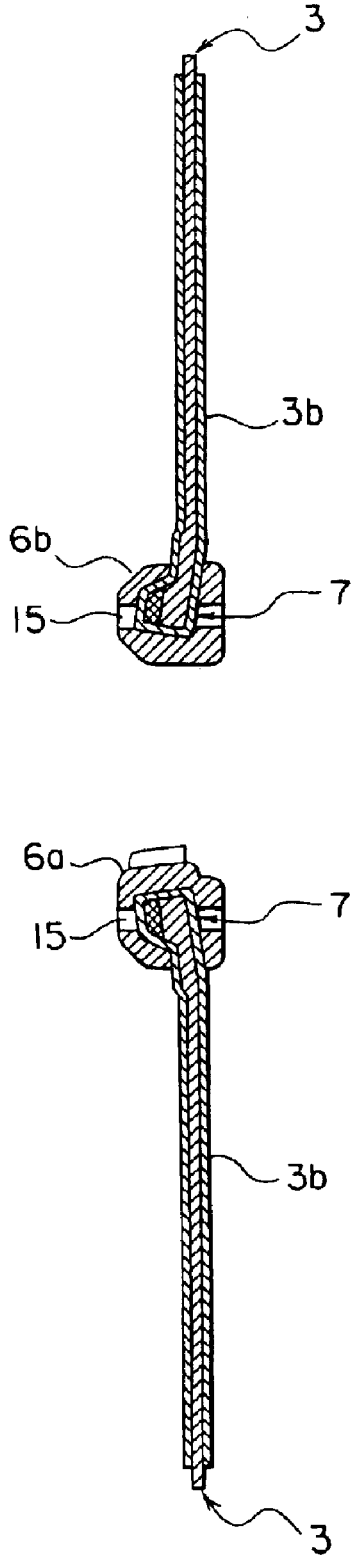
FIG. 5 is a view taken along the line V—V of FIG. 4.

If the tape portion 3*b* is bent around its border with the core portion 7 inside the molding cavity 13*a* and this bending condition is maintained with the pins 8*a*, 8*b*, resin flow-in space at a side opposite to the side where the core thread 4 of the core portion 7 is attached is enlarged compared with a case where the core portion 7 and the tape portion 3*b* are maintained on the same plane inside the molding cavity 13*a* without bending the tape portion 3*a* around its border with the core portion 7. Consequently, when the insert pin 6*a* and the box pin 6*b* are formed, the resin volume at the side opposite to the side where the core thread 4 is attached of the fastener tape 3 is increased although the outer shapes of the insert pin 6*a* and the box pin 6*b* are not different from conventional ones, as shown in FIGS. 4 and 5. Therefore, the thickness of the front face side and the rear face side can be made substantially equal. Accordingly, this separable bottom stop assembly not only allows smooth insertion of a slider (not shown) but also has improved durability because resin on the rear face side opposite to the side where the core thread 4 is attached never peels away upon usage of the fastener.

Reference numeral 15 in the figure denotes pin holes formed by the pins 8*a*, 8*b*. These holes are formed with a predetermined interval in the longitudinal direction in the insert pin 6*a* and the box pin 6*b*.

Figure 6:
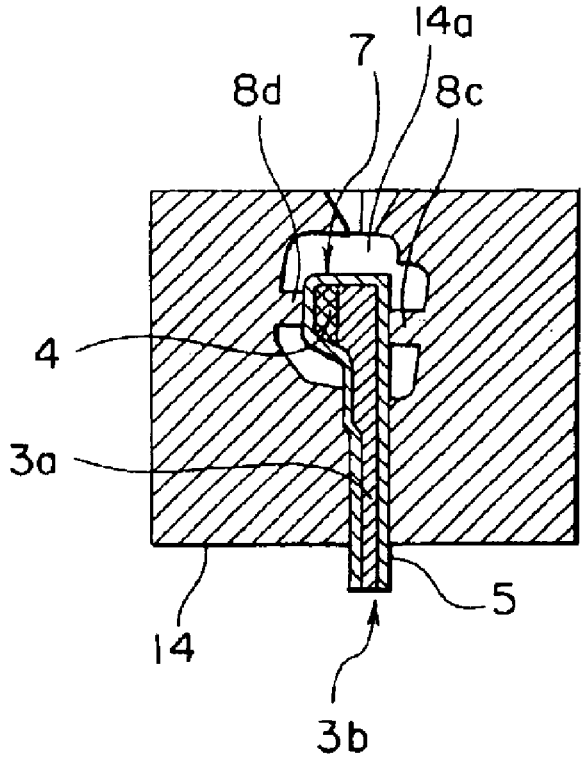
FIG. 6 is a sectional view showing a closed condition of a mold for molding an insert pin or a box pin of a separable bottom stop assembly integrally with a core portion of a fastener tape according to a second embodiment of the present invention.

FIG. 6 shows a condition in which the fastener tape portion 3*b* with reinforcement tape is inserted into a molding cavity 14*a* formed in a molding die 14 for molding the insert pin 6*a* or the box pin 6*b* of the separable bottom stop assembly 6 integrally with the core portion 7 in the second embodiment of the present invention. The sectional shape of the molding cavity 14*a* of the molding die 14 is not different from an ordinary one as in the first embodiment. Yet, the entire molding cavity 14*a* is inclined at a predetermined angle to the rear face side of the tape, or rightward in this figure. Unlike the first embodiment, the fastener tape portion 3*b* with the reinforcement tape inserted into the molding die 14 is not bent around its border with the core portion 7.

To insert the fastener tape portion 3*b* with the reinforcement tape into the molding cavity 14*a* and maintain its posture without inclining the core portion 7, means for keeping that posture is necessary. According to this embodiment, as the means for maintaining the posture, pins 8*c*, 8*d* are provided protrusively on both inner walls inside the molding cavity 14*a* across the core portion 7 so as to oppose each other in the same manner as in the first embodiment. Multiple pairs of the pins 8*c*, 8*d* are provided in the tape-length direction of the molding cavity 13*a*, as in the first embodiment.

Figure 7:
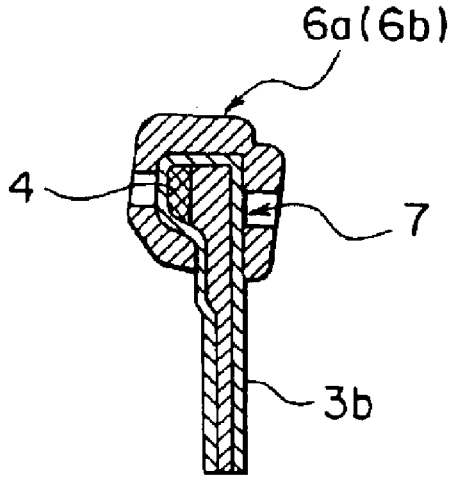
FIG. 7 is a partial transverse sectional view of an attaching portion of a separable bottom stop assembly of a slide fastener according to said second embodiment.

If the molding cavity 14*a* is formed such that it is inclined to the tape main body 3*a* side of the core portion 7 and the fastener tape portion is held with the pins 8*c*, 8*d* without bending the tape portion 3*b* around its border with the core portion 7, the resin flow-in space at the rear face side of the core portion 7 formed inside the molding cavity 14*a* is enlarged as in the first embodiment. Consequently, the resin volume at the side opposite to the side where the core thread 4 is attached is increased although the outer shapes of the insert pin 6*a* and the box pin 6*b* are not different from the conventional ones, as shown in FIG. 7. Thus, the thickness at the front face side and the rear face side can be made substantially equal. Accordingly, this separable bottom stop assembly not only allows smooth insertion of a slider (not shown) but also has improved durability because resin on the rear face side opposite to the side where the core thread 4 is attached never peels away upon usage of the fastener.

According to the first embodiment, the fastener tape is bent at the predetermined angle around the border between the core portion 7 and the tape portion 3*b* when the insert pin 6*a* and the box pin 6*b* are formed, as described above. However, special treatment for fixing the bending shape is not carried out on the core portion 7 and the tape main body

3*a* upon molding. Thus, after molding, the insert pin 6*a* and the box pin 6*b* turn to the same condition as shown in FIG. 7, in which the insert pin 6*a* and the box pin 6*b* are inclined at the predetermined angle.

What is claimed is:

1. A slide fastener with a separable bottom stop assembly, the slide fastener having linear fastener element rows along opposing side edges of a pair of fastener tapes and the separable bottom stop assembly comprising an insert pin and a box pin made of synthetic resin, which extend along respective ends of the fastener element rows, wherein said insert pin and said box pin are formed integrally by injection molding so as to include core portions, the core portions having no core threads at rear face sides adjacent end portions of the fastener element rows along the opposing side edges of the pair of fastener tapes, and having the core threads at front face sides, and having peripheral shapes allowing themselves to be inserted into element row guide grooves of a slider, and wherein said insert pin and said box pin are molded integrally such that the entire insert pin and the box pin in a width direction of the tapes incline toward rear face sides of the respective tapes from their inner side edges to outer side edges relative to tape planes of the fastener tapes, said rear face sides having no core threads of the core portions.

* * * * *